US005123493A

United States Patent [19]

Wenzel

[11] Patent Number: 5,123,493

[45] Date of Patent: Jun. 23, 1992

[54] VALVE USED IN A HYDRAULIC DRILLING JAR

[76] Inventor: Kenneth H. Wenzel, 147 Knottwood Road North, Edmonton, Alberta, Canada, T6K 4B8

[21] Appl. No.: 681,925

[22] Filed: Apr. 8, 1991

[51] Int. Cl.[5] ..... E21B 4/14

[52] U.S. Cl. ..... 175/297; 166/178

[58] Field of Search ..... 175/297, 299, 99, 300, 175/304; 166/178

[56] References Cited

U.S. PATENT DOCUMENTS

| | | | |
|---|---|---|---|
| 2,551,868 | 5/1951 | Brady | 255/27 |
| 3,880,248 | 4/1975 | Mason | 175/297 |
| 4,059,167 | 11/1977 | Berryman | 175/297 |
| 4,109,736 | 8/1978 | Webb et al. | 175/297 |
| 4,111,271 | 9/1978 | Perkins | 175/297 |
| 4,200,158 | 4/1980 | Perkins | 175/297 |
| 4,478,284 | 10/1984 | Tomm et al. | 166/297 |
| 4,550,789 | 11/1985 | Crow | 175/297 |
| 4,865,125 | 9/1989 | DeCuir | 166/178 |
| 5,007,479 | 4/1991 | Pleasants et al. | 166/178 |
| 5,033,557 | 7/1991 | Askew | 175/297 |

OTHER PUBLICATIONS

Brochure of Houston Engineers, Inc. re Hydra-Jar.

*Primary Examiner*—Ramon S. Britts
*Assistant Examiner*—Frank S. Tsay
*Attorney, Agent, or Firm*—Beveridge, DeGrandi & Weilacher

[57] ABSTRACT

An improvement in a valve used in a hydraulic drilling jar. A fluid chamber is divided into a first chamber and a second chamber by a restrictive bore. An annular valve is mounted on the exterior surface of the mandrel between a first shoulder and a second shoulder. The valve has a first end, a second end and an exterior surface. The valve substantially obstructs the flow of fluid within the fluid chamber when the valve is positioned in the restrictive bore. The valve has a first bypass passage whereby fluid passes from the first chamber to the second chamber creating a time delay as the valve slowly moves out of the restrictive bore whereupon the telescopic movement of the mandrel in a first direction is unrestricted. The valve has a second bypass passage whereby fluid passes from the second chamber to the first chamber creating a time delay as the valve slowly moves out of the restrictive bore whereupon the telescopic movement of the mandrel in a second direction is unrestricted. The valve is slidably moveable on the mandrel between the first shoulder and the second shoulder such that the second shoulder obstructs the second bypass passage when the mandrel moves in the first direction and the first shoulder obstructs the first passage when the mandrel moves in the second direction.

11 Claims, 12 Drawing Sheets

VALVE USED IN A HYDRAULIC DRILLING JAR

The present invention relates to an improvement in a of an hydraulic drilling jar.

BACKGROUND OF THE INVENTION

When drilling an oil well the drill stem consisting of a plurality of sections of threadedly connected drill pipe sometimes gets wedged against the side wall of the borehole. When this happens a tool commonly known as a drilling jar is used to cause an impact which will "jar" the drill stem and hopefully release the drill stem from its position. The tool is constructed with a hammer portion which upon activation of the tool strikes an anvil portion. The tool is activated by a predetermined plateau for tension if it is desired to jar up or compression if it is desired to jar down. The tool telescopes until the hammer and anvil portions strike with a jarring impact. It is common in the art for the drilling jars to use hydraulic release mechanisms. Hydraulic release mechanisms can be of varying designs, but usually have a primary fluid passage which is obstructed by a valve positioned in a restrictive bore. The valve configuration prevents the free movement of the hammer and anvil portions until such time as the valve moves out of the restrictive bore. In order to effect movement of the valve, hydraulic fluid slowly bleeds through a fluid bypass creating a time delay until the valve clears the primary fluid passage allowing free movement of the hammer portion and anvil portion of the tool. When the restrictive bore is no longer obstructed by the valve, the hammer and anvil can telescope unobstructed to create the desired impact.

At the present time most hydraulic drilling jars are only capable of jarring in one direction. Those hydraulic drilling jars which are two way jars have two separate activating mechanisms which artificially lengthen the tool and result in unnecessarily complex valving.

SUMMARY OF THE INVENTION

What is required is an hydraulic drilling jar with a simple form of two way valve.

According to the present invention there is provided an improvement in a valve for an hydraulic drilling jar having a tubular housing with an interior surface defining an inner bore, a mandrel telescopically received within the inner bore of the housing, one of the mandrel or the housing having a first projecting anvil and a second projecting anvil in spaced apart relation, the other of the mandrel or the housing having a first projecting hammer and a second projecting hammer in spaced apart relation, one of the mandrel or housing being telescopically moveable in a first direction until the first hammer strikes the first anvil and telescopically moveable in a second direction until the second hammer strikes the second anvil. The improvement is comprised of a fluid chamber having a first end and a second end disposed between the housing and the mandrel. The fluid chamber is divided into a first chamber and a second chamber by a restrictive bore. Sealing means are provided for sealing the first end and second end of the fluid chamber. An annular valve is mounted on the exterior surface of the mandrel between a first shoulder and a second shoulder. The valve has a first end, a second end and an exterior surface. The valve substantially obstructs the flow of fluid within the fluid chamber when the valve is positioned in the restrictive bore thereby hydraulically coupling the mandrel and the housing until a compression or tension force is exerted. The valve has a first bypass passage whereby fluid passes from the first chamber to the second chamber creating a time delay as the valve slowly moves out of the restrictive bore whereupon telescopic movement in the first direction is unrestricted. The valve has a second bypass passage whereby fluid passes from the second chamber to the first chamber creating a time delay as the valve slowly moves out of the restrictive bore whereupon telescopical movement in a second direction is unrestricted. The valve is slidably moveable on the mandrel between the first shoulder and the second shoulder such that the second shoulder obstructs the second bypass passage when the mandrel moves in the first direction and the first shoulder obstructs the first passage when the mandrel moves in the second direction.

The bypass passage can take a variety of forms, all that is required is a clearance spaced between the valve and the restrictive bore. In its simplest form the first bypass passage is comprised of a longitudinal groove in the exterior surface of the valve or a transverse groove in the second end of the valve, and the second bypass passage is similarly comprised of a longitudinal groove in the exterior surface of the valve or a transverse groove in the first end of the valve.

The forces working upon the valve are extreme. The valve will tend to deform if not positioned wholly within the restrictive bore, when a tension or compression force is exerted. Once the valve is deformed, the hydraulic drilling jar will not work properly. Once the valve is deformed, it either will no longer enter the restrictive bore or cannot be dislodged from the restrictive bore.

Although beneficial results may be obtained through the use of an hydraulic drilling jar having a valve with a longitudinal groove, longitudinal grooves can become plugged or partially obstructed. There is, therefore, a danger of "lock up", where the valve becomes lodged in the restrictive bore. Even more beneficial results may therefore be obtained when the bypass passage is comprised of a longitudinal bore through the valve having an adjoining transverse groove in the second end of the valve, and the second bypass passage is comprised of a longitudinal bore through the valve having an adjoining transverse groove in the first end of the valve.

Although beneficial results may be obtained through the use of an hydraulic drilling jar having a valve with a longitudinal bore, it is sometimes difficult to get the valve to return to its resting position within the restrictive bore. Even more beneficial results may therefore be obtained when the first bypass passage is comprised of a longitudinal bore through the valve having an adjoining transverse bore adjacent the second end of the valve, and the second bypass passage is comprised of a longitudinal bore through the valve having an adjoining transverse bore adjacent the first end of the valve.

Although beneficial results may be obtained through the use of an hydraulic drilling jar having a valve with both longitudinal and connecting transverse bores, even more beneficial results may therefore be obtained when the first bypass passage is comprised of an "L" shaped bore through the valve having a first portion extending longitudinally, a second portion adjacent the second end of the valve which extends transversely, and a longitudinal groove extending across the exterior surface of the valve from the second portion to the second end of the valve, and the second bypass passage is comprised of an "L" shaped bore through the valve having a first portion extending longitudinally, a second portion adjacent the first end of the valve which extends transversely, and a longitudinal groove extending across the exterior surface of the valve from the second portion to the first end of the valve.

Although beneficial results may be obtained through the use of an hydraulic drilling jar having a valve as described, it is sometimes difficult to obtain a consistent time delay, as the valve slowly moves out of the restrictive bore prior to the jarring action of the tool occurring. Even more beneficial results may therefore be obtained by placing a metering device disposed in the bypass passages to meter the flow of fluid.

Although beneficial results may be obtained through the use of an hydraulic drilling jar as described, even more beneficial results may therefore be obtain by having a mechanical latch disposed between the housing and the mandrel to lock the mandrel within the housing until a preset tension or compression force is exerted upon the mandrel. The use of a mechanical latch eliminates the possibility of unintentional jarring and also allows the hydraulic drilling jar to be run in compression within the drill string up to the predetermined latch setting.

Although beneficial results may be obtained through the use of an hydraulic drilling jar as described hydrostatic pressure downhole can have adverse effect on the tools operations and chips of metal from the mechanical latch can plug the metering device. Even more beneficial results may therefore be obtained by having the mechanical latch positioned in a fluid filled latch chamber having a first end and a second end. The fluid chamber which has the restrictive bore adjoins the latch chamber. Pressure balancing pistons are positioned at either end of the latch chamber. Each piston has a first face and a second face. A passage is provided whereby drilling fluids exert a force upon the second face of the piston positioned at the second end of the latch chamber. This results in the piston moving to a position of equilibrium wherein a like pressure is exerted by the first face of the piston upon fluids in the latch chamber. The piston at the first end of the latch chamber exerts a like pressure upon fluids within the fluid chamber and prevents metal chips from migrating from the latch chamber to the fluid chamber.

BRIEF DESCRIPTION OF THE DRAWINGS

These and other features of the invention will become more apparent from the following description in which reference is made to the appended drawings, wherein.

Figure 1:
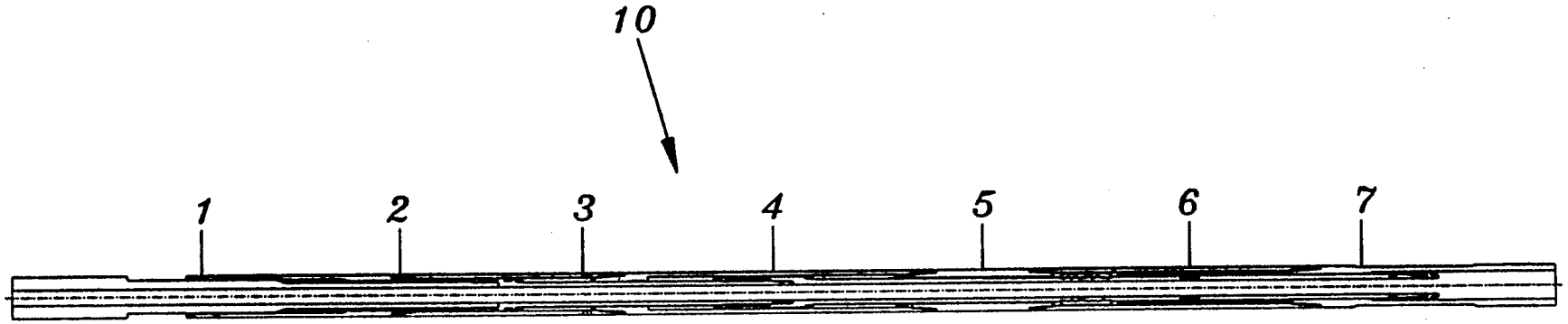
FIG. 1 is a longitudinal section view of a preferred embodiment of the invention.

FIG. *2a* through *2h* are enlarged longitudinal section views of portions of the drilling jar illustrated in FIG. 1.

Figure 3:
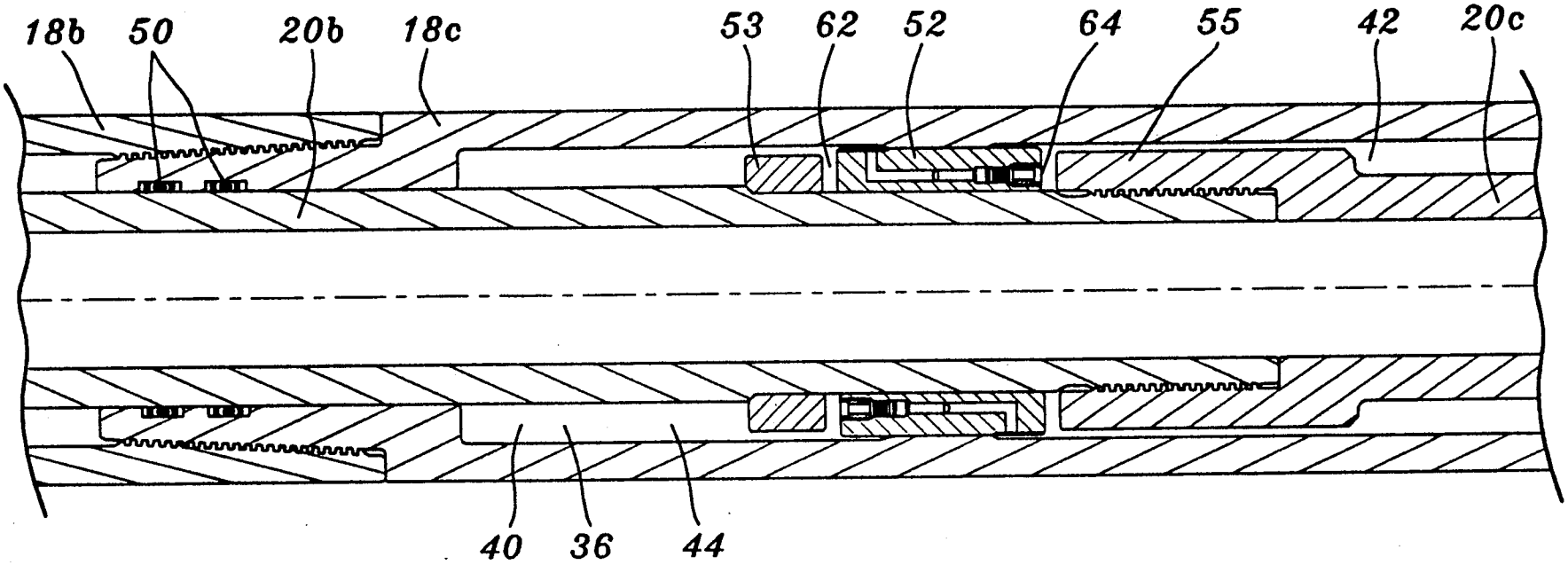

FIG. 3 is a detailed longitudinal section view of a portion of the drilling jar illustrated in FIG. 1, with the hydraulic valve positioned in a restrictive bore.

Figure 4:
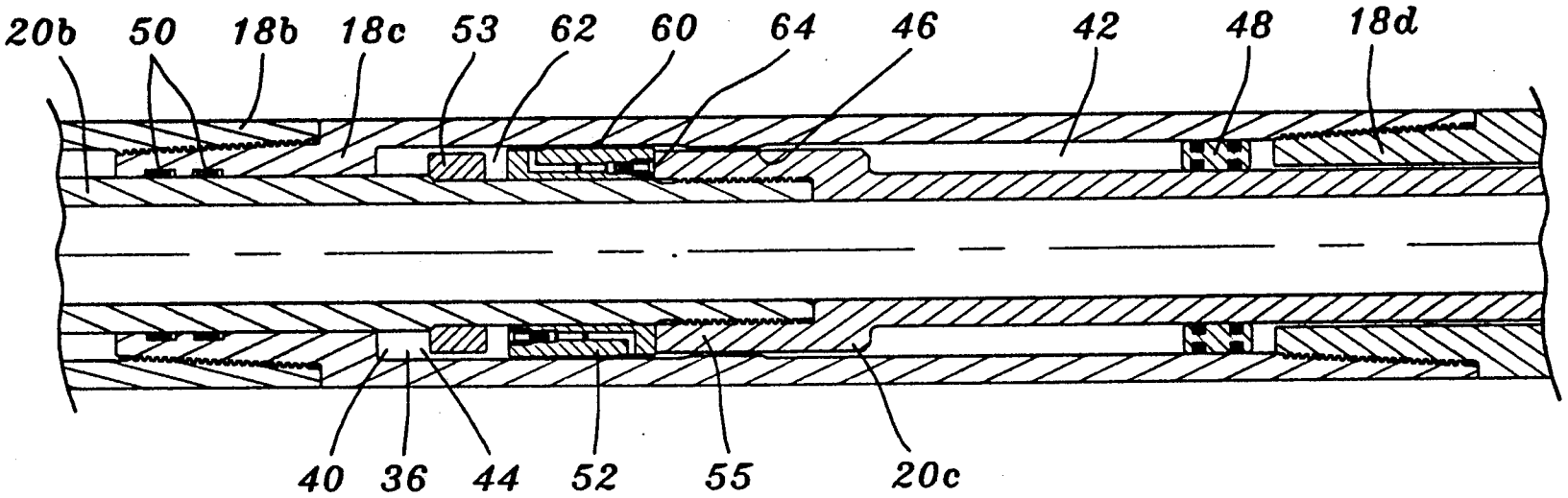
Figure 5:
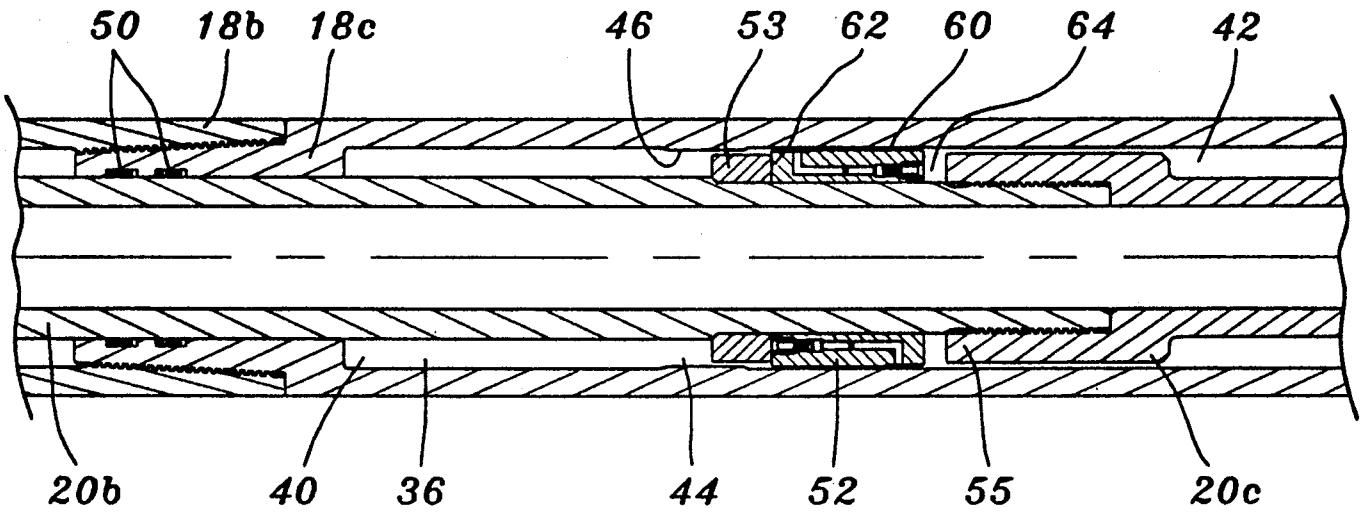

FIG. 4 is a detailed longitudinal section view of a portion of the drilling jar illustrated in FIG. 1, with the hydraulic valve positioned in a first chamber. FIG. 5 is a detailed longitudinal section view of a portion of the drilling jar illustrated in FIG. 1, with the hydraulic valve positioned in a second chamber.

Figure 6:
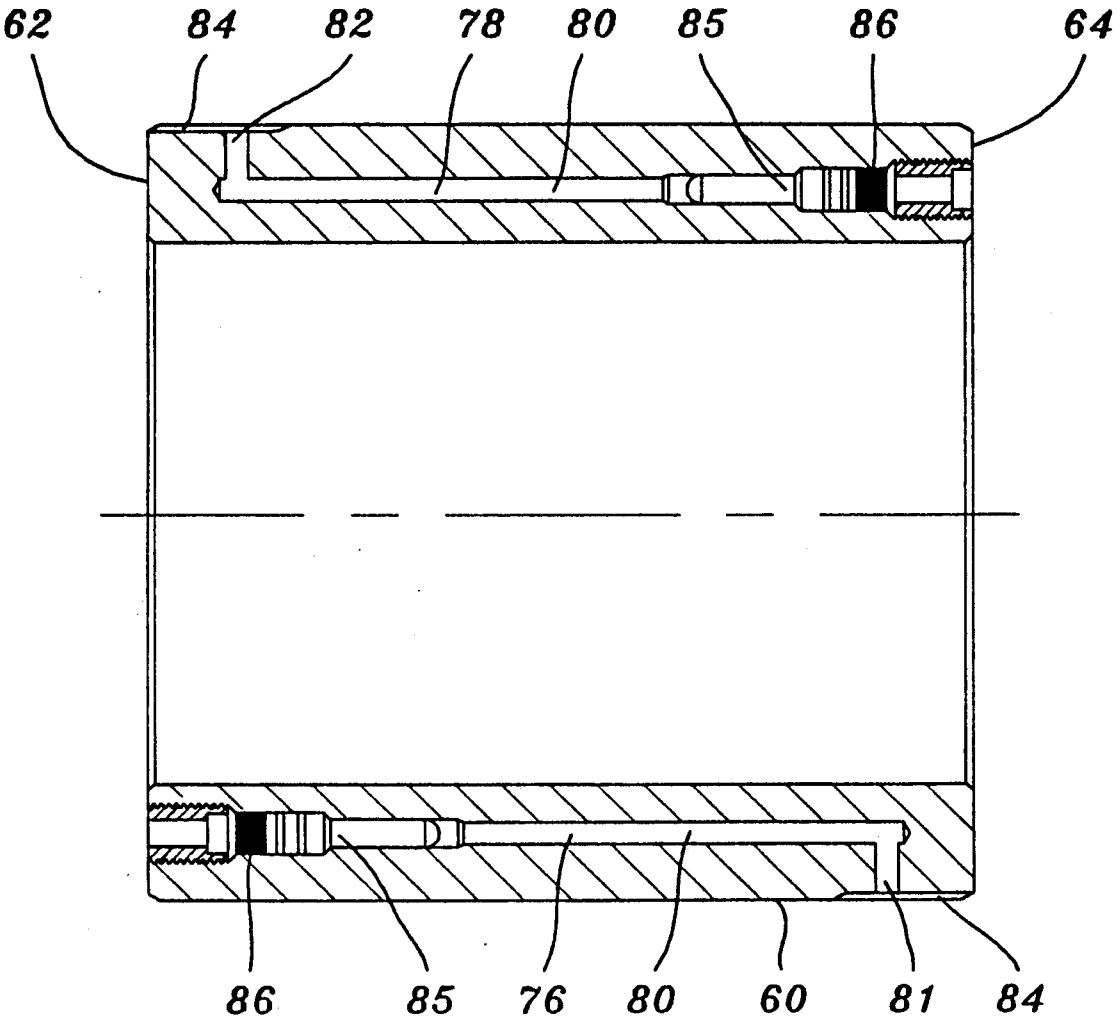

FIG. 6 is a section view of a preferred embodiment of the hydraulic valve.

Figure 7:
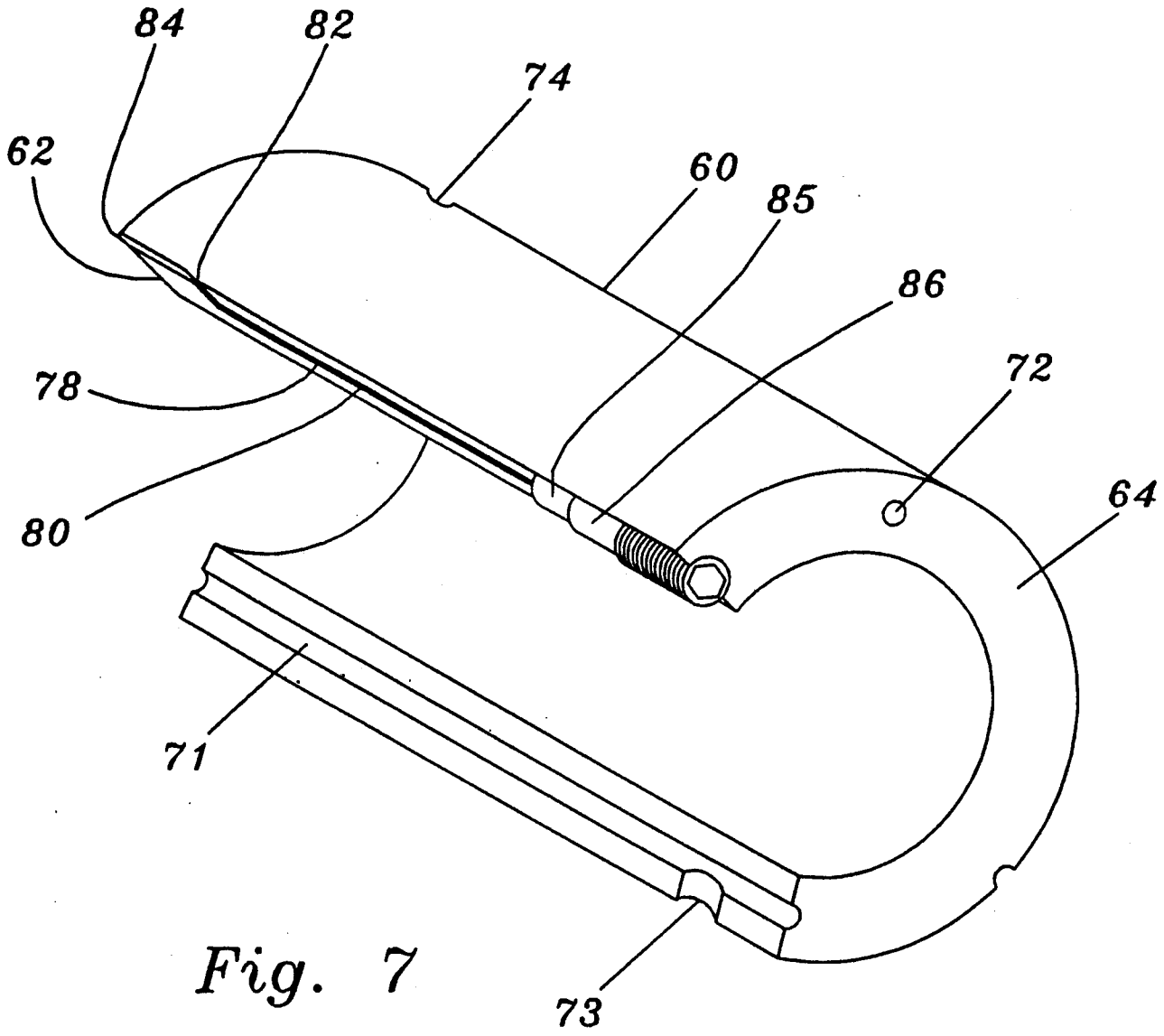

FIG. 7 is a cut away view of the hydraulic valve illustrated in FIG. 6.

Figure 8:
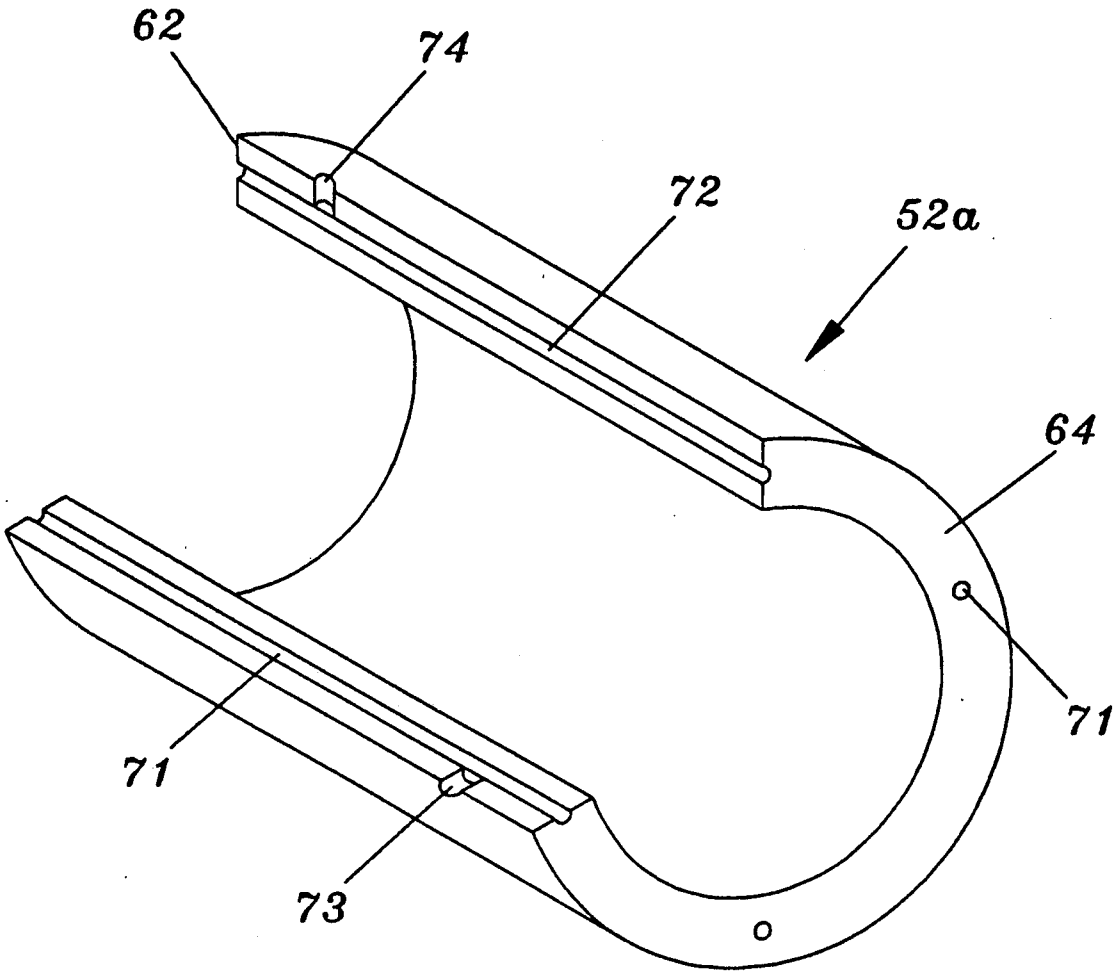

FIG. 8 is a cut away view of a first alternate embodiment of the hydraulic valve.

Figure 9:
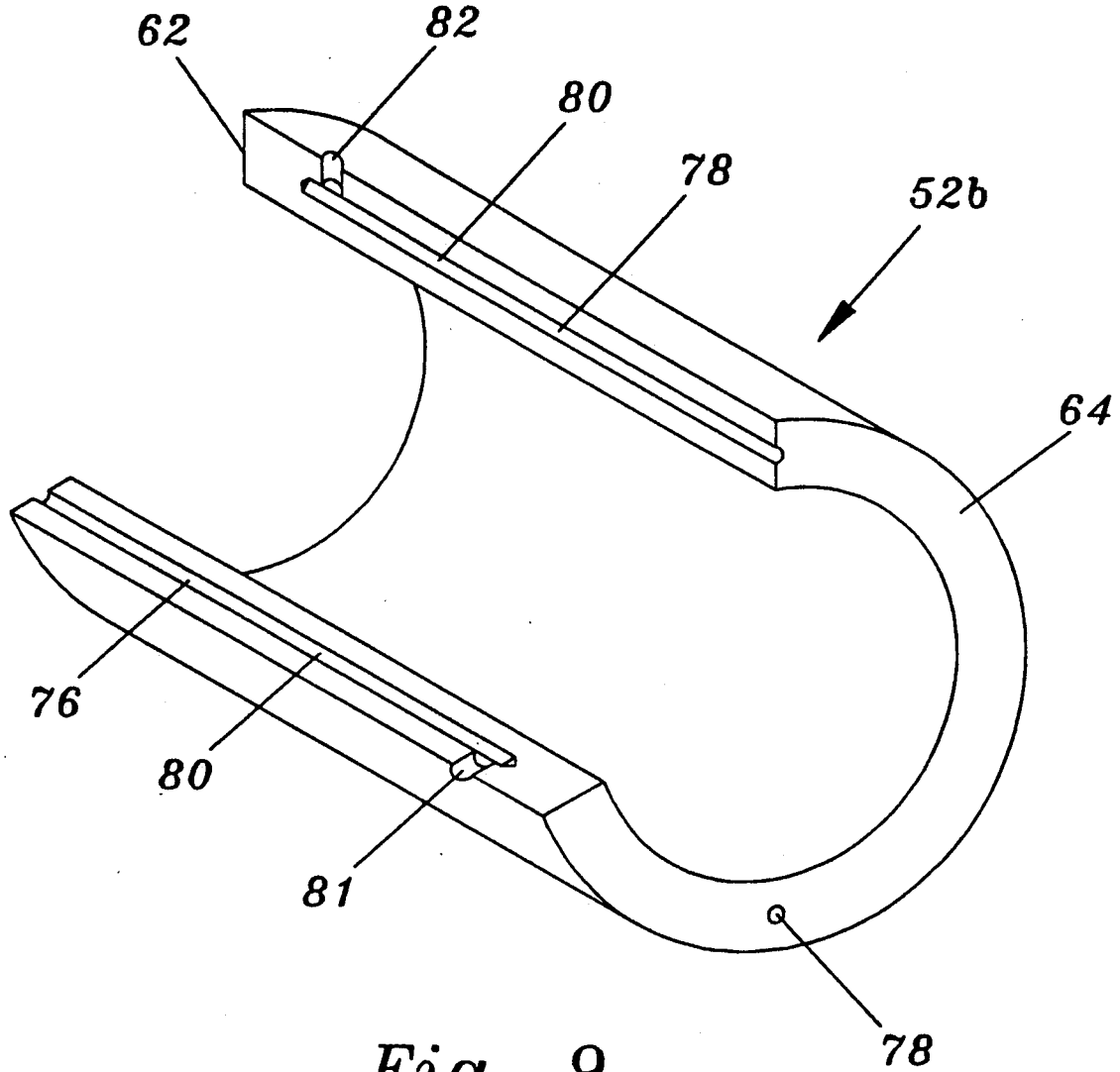

FIG. 9 is a detailed cut away view of a second alternate embodiment of the hydraulic valve.

DETAILED DESCRIPTION OF THE PREFERRED EMBODIMENT

The preferred embodiment will now be described with reference to FIGS. 1 through 7. The preferred embodiment, generally designated by reference numeral 10, is an hydraulic drilling jar. The preferred embodiment is the result of extensive development and testing. The invention lies in the improved hydraulic valve configuration. During the course of such development and testing a number of alternative valve configurations were developed. These alternative valve configurations are illustrated in FIGS. 8 and 9. The alternative valves are operable, but had shortcomings which were addressed in the preferred embodiment. These alternative valves will be described, together with background on the shortcomings which lead to further development.

Preferred embodiment 10 and the alternate valve configurations are all intended to be incorporated in drilling jars having similar basic structure. This basic structure is illustrated in FIG. 1. FIG. 1 is marked with 7 division markings which represent arbitrary divisions made for the purpose of enlarging FIG. 1, for illustration in FIGS. *2a* through *2h*. The primary components of drilling jar 10 consist of a tubular housing 18, and a mandrel 20. Housing 18 consists of a number of threadedly connected components; 18*a* through 18*f*. Mandrel 20 consists of a number of threadedly connected components; 20*a* through 20*d*. Housing 18 has a first end 19, a second end 21, and an interior surface 22 defining an inner bore 24. Second end 21 of housing 18 serves as a first projecting anvil 26. A second projecting anvil 28 encroaches into inner bore 24 of housing 18. First projecting anvil 26 and second projecting anvil 28 are in spaced apart relation. Mandrel 20 is telescopically received within inner bore 24 of housing 18. Mandrel 20 has an exterior surface 30 with a first projecting hammer 32 and a second projecting hammer 34 encroaching into inner bore 24 in spaced apart relation. Referring to FIGS. *2b* and *2c*, mandrel 20 is telescopically moveable in a first direction toward first end 19 of housing 18 until first hammer 32 strikes first anvil 26. Mandrel 20 is, similarly, telescopically moveable in a second direction toward second end 21 of housing 18 until second hammer 34 strikes second anvil 28. Referring to FIGS. *2d* and *2e*, a fluid chamber 36 is formed between housing 18 and mandrel 20. Fluid chamber 36 has a first end 38 and a second end 40. First end 38 of fluid chamber 36 is sealed by a pressure balancing piston 48. Second end 40 of fluid chamber 36 is sealed by a plurality of fixed seals 50. Fluid chamber 36 is actually subdivided into two smaller chambers 42 and 44 by a restrictive bore 46. For convenience of reference the chamber adjacent first end 38 will be referred to as first chamber 42, and the chamber adjacent second end 40 will be referred to as second chamber 44.

The difference between the preferred and the alternate embodiments relates to the structure of an annular valve 52 which is positioned in fluid chamber 36. In order to distinguish between the valves the preferred embodiment as illustrated in FIG. 6 and 7, will be identified by reference numeral 52. The alternate embodiments of valve 52 as illustrated in FIGS. 8 and 9, will be identified by reference numeral 52*a* and 52*b*, respectively. Annular valve 52 is positioned between a first shoulder 53 and a second shoulder 55, on exterior surface 30 of mandrel 20 within fluid chamber 36. The purpose of valve 52 is to substantially obstruct the flow of fluid within fluid chamber 36 when the valve is positioned in restrictive bore 46 thereby hydraulically coupling mandrel 20 and housing 18 until a compression or tension force is exerted upon mandrel 20. The valve has at least one bypass passage, the form of which varies in the various embodiments. The valve has a first end 62, a second end 64, and an exterior surface 60.

The operation of the valve requires that when not required for jarring the valve be positioned in a neutral position within restrictive bore 46. When it is desired to use the tool to create a jarring impact, a compression or tension force is exerted upon mandrel 20. Fluid slowly bleeds from one of chambers 42 or 44 to the other of the chambers through the bypass passage creating a time delay before the valve moves out of restrictive bore 46 thereby permitting mandrel 20 to freely telescope. The problems encountered in having the valve correctly operate as a "two way" valve permitting jarring both in tension and compression relate to "lock up" of the valve, the positioning of the valve in a "neutral" position within restrictive bore 46, and controlling the duration of the time delay created by the bypass of fluids through the bypass passage. It is difficult to get the valve to return to a neutral position within the restrictive bore. If pressure is exerted upon the valve when it is not wholly within the restrictive bore, the valve deforms. If the valve deforms it either becomes lodged in the restrictive bore, or is not longer able to enter the restrictive bore.

In early prototypes of the invention (not illustrated) a first bypass passage was provided in the form of a longitudinal groove in the exterior surface 60 of the valve. A second bypass passage was also provided in the form of a longitudinal groove in the exterior surface 60 of the valve. The longitudinal grooves provided the necessary clearance space between the valve and restrictive bore 46. The valve was slidably moveable on mandrel 20 between first shoulder 53 and second shoulder 55. The second shoulder 55 moved against second end 64 of the valve to obstruct the second bypass passage when mandrel 20 moved in the first direction. The first shoulder 53 moved against first end 62 to obstruct the first bypass passage when mandrel 20 moved in the second direction. This embodiment, although workable, was not viewed as being as reliable as desired. The longitudinal grooves tended to become clogged resulting at worst in "lock up" and at best in inconsistent time delays prior to the jarring action.

A similar result was achieved through the use of transverse grooves in the ends of the valve. A first bypass passage was provided in the form of a transverse groove in second end 64 of the valve. A second bypass passage was provided in the form of a transverse groove in the first end 62 of the valve.

In a subsequent prototype (not shown) the bypass passages of the valve were modified. A first bypass passage was provided in the form of a longitudinal bore through the valve having an adjoining transverse groove in second end 64 of the valve. A second bypass passage was also provided in the form of a longitudinal bore through the valve having an adjoining transverse groove in first end 62 of the valve. The longitudinal bores provided the necessary fluid flow space through the valve. The transverse grooves provided the necessary clearance space between the ends of the valve and the shoulders. The valve was slidably moveable on mandrel 20 between first shoulder 53 and second shoulder 55. The second shoulder 55 moved against second end 64 of the valve to obstruct the second bypass passage when mandrel 20 moved in the first direction. The first shoulder 53 moved against first end 62 to obstruct the first bypass passage when mandrel 20 moved in the second direction. This improved version of the valve resolved the problem encountered with first alternate embodiment relating to "lock up", but the problems relating to regulating the duration of the time delay and the repositioning of the valve in a neutral position remained.

Referring to FIG. 8, the first alternate valve configuration illustrated represents an improvement over the earlier prototypes. Valve 52*a* has a first bypass passage consisting of a longitudinal bore 71 through valve 52*a* having an adjoining transverse bore 73 adjacent second end 64. Valve 52*a* similarly has a second bypass passage consisting of a longitudinal bore 72 through valve 52*a* having an adjoining transverse bore 74 adjacent first end 62. Second shoulder 55 moves against second end 64 of valve 52*a* to obstruct longitudinal bore 71 when mandrel 20 moves in the first direction. First shoulder 53 moves against first end 62 of valve 52*a* to obstruct longitudinal bore 72 when mandrel 20 moves in the second direction. This embodiment allowed valve 52*a* to return to a neutral position. It was felt, however, that the performance of a jarring occurred could be improved upon.

Referring to FIG. 9, second alternate valve configuration 52*b* was developed to provide more consistency in jarring that the first alternate valve 52*a*. Valve 52*b* has a first bypass passage consisting of an "L" shaped bore 76 having a first portion 80 extending longitudinally, and a second portion 81 adjacent second end 64 of the valve which extends transversely. Valve 52*b* has a second bypass passage consisting of an "L" shaped bore 78 having a first portion 80 extending longitudinally and a second portion 82 adjacent first end 62. Second shoulder 55 moves against second end 64 of valve 52*b* to obstruct "L" shaped bore 78 when mandrel 20 moves in the first direction. First shoulder 53 moves against first end 62 of valve 52*a* to obstruct longitudinal bore 76 when mandrel 20 moves in the second direction. Valve 52*b* showed improvement in terms of allowing the valve to be easily moved back into the restrictive bore after a jarring had occurred. It was determined by the Applicant that the control over the time delay could be improved, which lead to the development of valve 52.

Valve 52 used in the preferred embodiment will now be described with reference to FIGS. 6 and 7. Valve 52 combines the best features of valves 52*a* and 52*b*. Valve 52 has a first bypass passage and a second bypass passage of like construction to embodiment 52*b*. The first bypass passage in the form of an "L" shaped bore 76 having a first portion 80 extending longitudinally from first end 62, a second portion 81 adjacent second end 64 extends transversely, and a longitudinal groove 84 which extends across exterior surface 60 from second portion 81 to second end 64. The second fluid bypass passage consists of an "L" shaped bore 78 having a first portion 80 extending longitudinally from second end 64, a second portion 82 adjacent first end 62 which extends transversely, and a longitudinal groove 84 which extends across exterior surface 60 from second portion 82 to first end 62. A metering device 85 is disposed in first portion 80 of each of "L" shaped bores 76 and 78. A first fluid return passage and a second fluid return passage are provided of like construction to that provided in valve 52*a*. The first fluid return passage consists of a longitudinal bore 72 with a connecting transverse bore 74 adjacent first end 62 of valve 52. The second fluid return passage consists of a longitudinal bore 71 with a connecting transverse bore 73 adjacent second end 64 of valve 52. The fluid return passages provide an alternate path for use by fluids when repositioning valve 52 in restrictive bore 46, so that all fluids need not pass through metering device 85. Valve 52 is slidably movable on mandrel 20 between first shoulder 53 and second shoulder 55. First shoulders 53 and second shoulder 55 play a key role when valve 52 is positioned within restrictive bore 46. Second shoulder 55 obstructs "L" shaped bore 78 and fluid return passages 71 and 72 when mandrel 20 moves in the first direction. This means that the only path available for fluids to flow from first chamber 42 to second chamber 44 is through metering device 85 in "L" shaped bore 76. First shoulder 53 obstructs "L" shaped bore 76 and fluid return passages 71 and 72 when mandrel 20 moves in the second direction. This means that the only path available for fluids to flow from second chamber 44 to first chamber 42 is through metering device 85 in "L" shaped bore 78. The metering device presently being used by the applicant is commercially available under the trade mark "Visco jet". The "Visco Jet" comes with a built in filter, but in addition the Applicant uses a further filter 86 along with metering device 85. The provision of longitudinal grooves 84 provide a fluid passage from "L" shaped bores 76 and 78. When a force is exerted to reposition valve 52 in restrictive bore 46, first shoulder 53 or second shoulder 55 will obstruct the flow of fluids through longitudinal bores 71 and 72, respectively, of the fluid flow return passages. As valve 52 is pushed back into position, fluids flow into longitudinal bores 71 or 72 and have a path for egress through transverse bores 73 or 74, respectively. This improves the speed at which valve 52 may be reset. Of course, once valve 52 enters restrictive bore 46 transverse bores 73 and 74 are obstructed by restrictive bore, thereby preventing valve 52 from moving through restrictive bore 46.

The use and operation of preferred embodiment 10 having valve 52 will now be described with reference to FIGS. 1 through 7. When not required for jarring preferred embodiment 10 is run with valve 52 in a "neutral" position within restrictive bore 46, as illustrated in FIG. 3. When a force is exerted in order to cause a jarring to occur in a first direction shoulder 55 forms a metal to metal seal which prevents the flow of fluids through "L" shaped bore 78 and longitudinal bores 71 and 72. Mandrel 20 telescopically moves very slowly toward first end 19 of housing 12 until valve 52 has cleared restrictive bore 46. The force causes a flow of fluids from chamber 42 to chamber 44. These fluids can only flow through "L" shaped bore 76. Fluids from chamber 42 enter longitudinal first portion 80, pass through transverse second portion 81 and along longitudinal grooves 84 in exterior surface 60 of valve 52 to chamber 44. In passing through "L" shaped bore 76, the fluids must flow through metering device 85. Metering device 85 only permits fluids to flow at a predetermined flow rate making the time interval for valve 52 to clear restrictive bore 46 accurately calculable. Valve 52 then clears restrictive bore 46 and assumes the position illustrated in FIG. 4. After a jarring in a first direction has occurred a force is exerted to "push" valve 52 back into position. When valve 52 is being pushed back into position, shoulder 53 closes off "L" shaped bore 76 and longitudinal bores 71 and 72. "L" shaped bore 78 is unobstructed, but the presence of metering device 85 restricts the flow of fluids therethrough. The path the fluids follow in order to restore valve 52 to a neutral position is in through longitudinal bore 72 and out through transverse bore 74. Once valve 52 enters restrictive bore 46, the further flow of fluids through transverse bore 74 is obstructed by restrictive bore 46. When a force is exerted in order to cause a jarring to occur in a second direction shoulder 53 forms a metal to metal seal which prevents the flow of fluids through "L" shaped bore 76 or longitudinal bores 71 and 72. Mandrel 20 telescopically moves very slowly toward second end 21 of housing 12 until valve 52 has cleared restrictive bore 46. The force causes a flow of fluids from chamber 44 to chamber 42. These fluids can only flow through "L" shaped bore 78. Fluids from chamber 44 enter longitudinal first portion 80, pass through transverse second portion 82 and along longitudinal grooves 84 in exterior surface 60 of valve 52 to chamber 42. In passing through "L" shaped bore 78, the fluids must flow through metering device 85. Metering device 85 only permits fluids to flow at a predetermined flow rate making the time interval for valve 52 to clear restrictive bore 46 accurately calculable. Valve 52 then assumes the position illustrated in FIG. 5. After a jarring in a second direction has occurred a force is exerted to "push" valve 52 back into position. When valve 52 is being pushed back into position, shoulder 55 closes off "L" shaped bore 78 and longitudinal bores 71 and 72. "L" shaped bore 76 is unobstructed, but the presence of metering device 85 restricts the flow of fluids therethrough. The path the fluids follow in order to restore valve 52 to a neutral position is in through longitudinal bore 71 and out through transverse bore 73. When valve 52 enters restrictive bore 46, the further flow of fluids through transverse bore 73 is obstructed by restrictive bore 46.

Figure 2A:
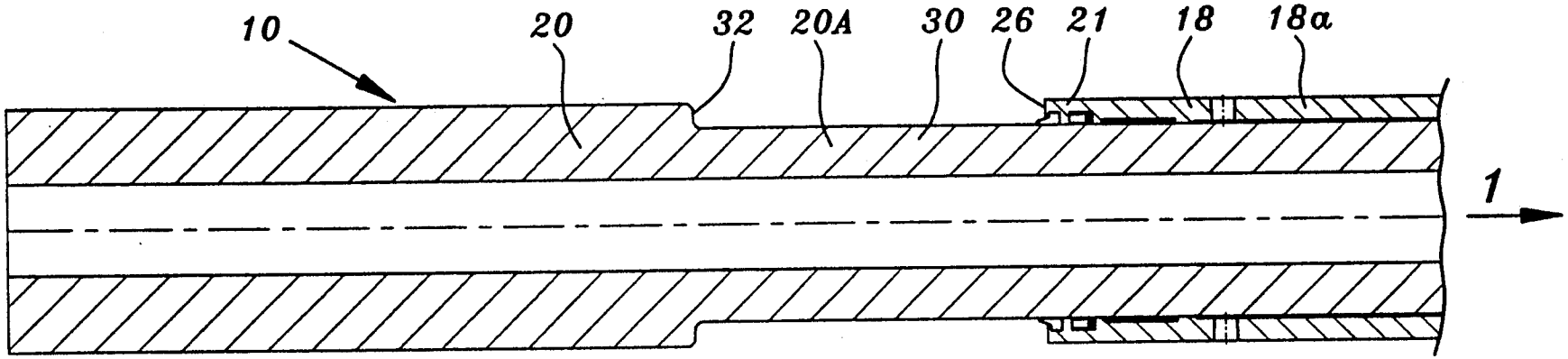
Figure 2B:
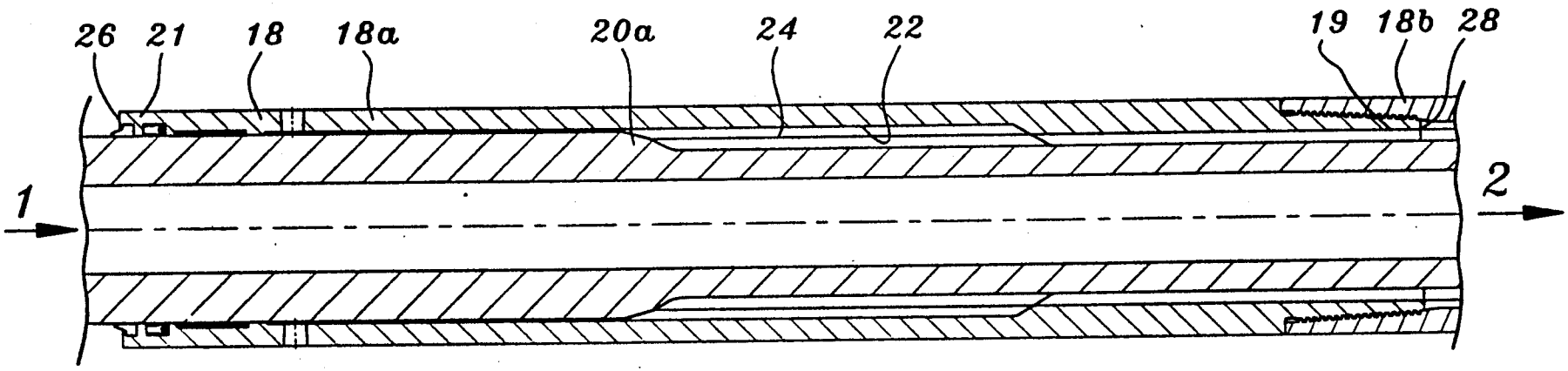
Figure 2C:
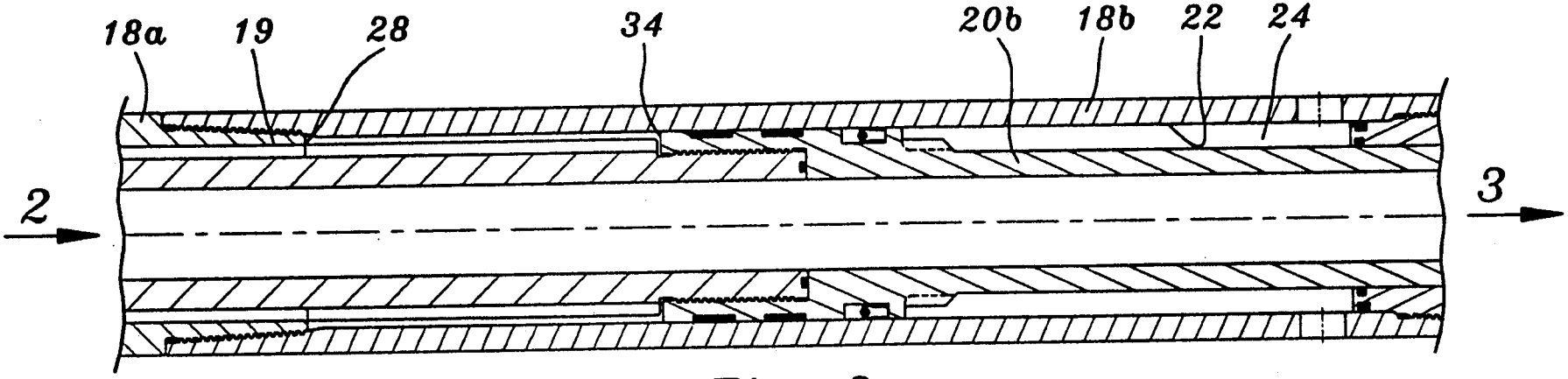
Figure 2D:
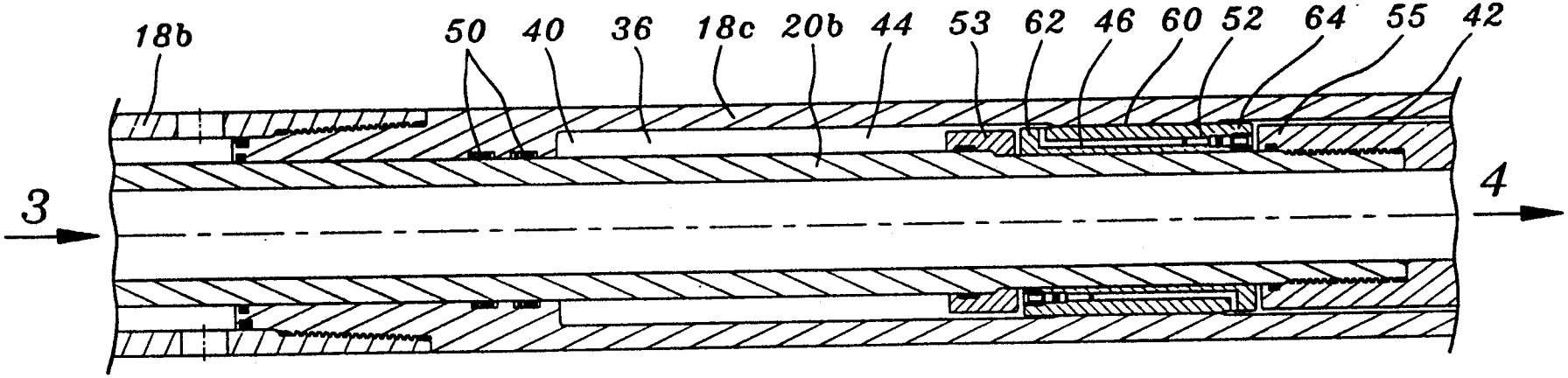
Figure 2E:
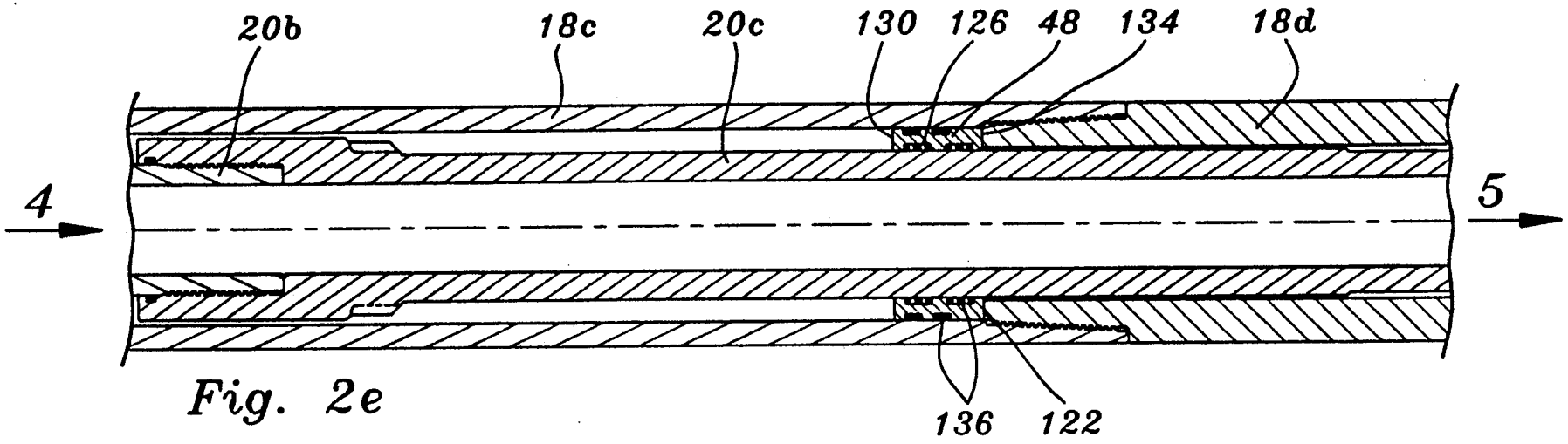
Figure 2F:
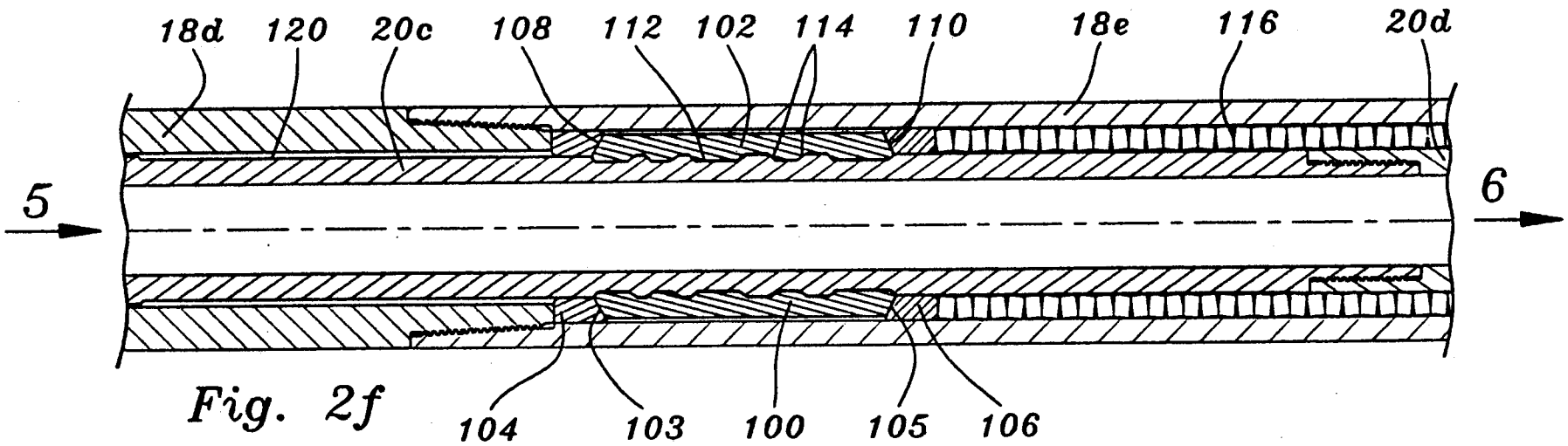
Figure 2G:
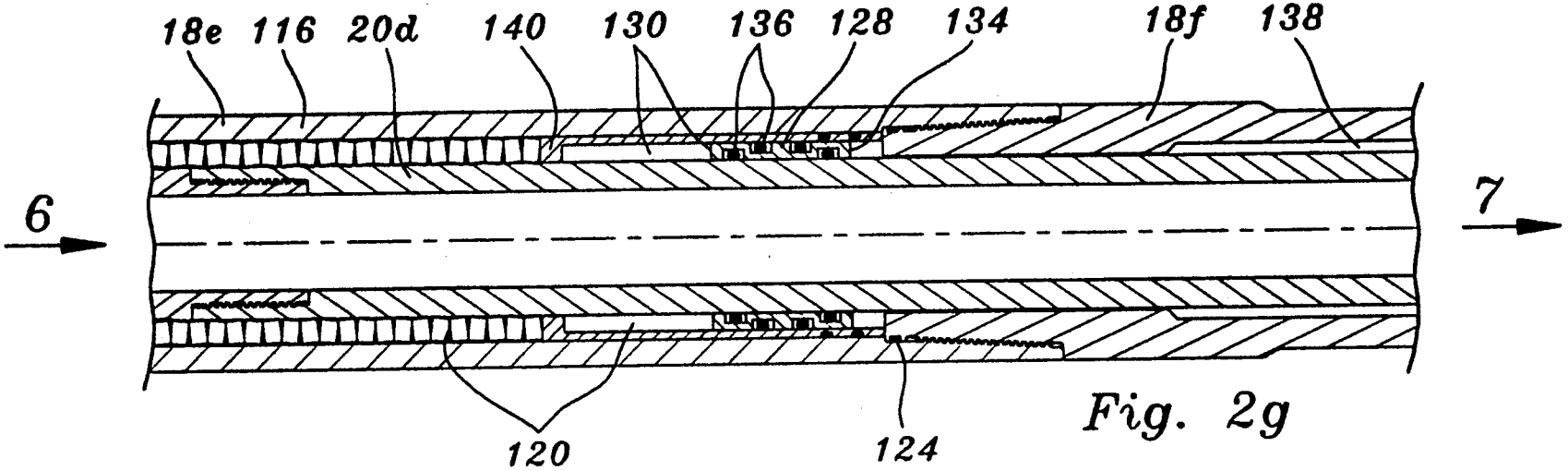
Figure 2H:
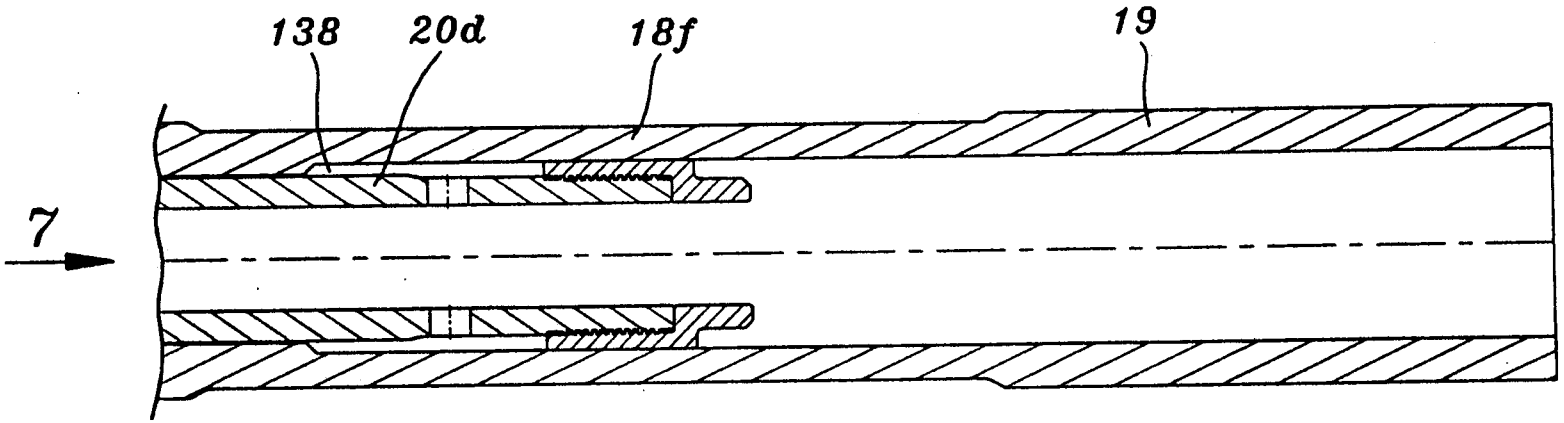

Although the use of valve 52 as a strictly hydraulic two way jar configuration is operable, the Applicant determined that improved performance could be obtained when valve 52 was used in combination with a form of mechanical latch. It is desirable to place weight upon the drill bit during drilling operations. Without the use of a mechanical latch this weight tended to move valve 52 to some extent out of the desired "neutral" position within restrictive bore 46, as illustrated in FIG. 3. When used in combination with a mechanical latch, mandrel 20 is unable to move and is therefore unable to exert any force upon valve 52 until the mechanical latch is released. A mechanical latch can be given a fairly exact triggering plateau. The combination permits the advantage of a defined triggering plateau provided by the mechanical latch, together with two way movement and a defined time delay as provided by valve 52. A mechanical latch 100 is illustrated in FIGS. 2*f* and 2*g*. Mechanical latch 100 consists of a number of segments 102 having inclined surfaces 103 and 105. Segments 102 are positioned between annular rings 104 and 106 which also have inclined surfaces 108 and 110, respectively. Segments 102 have a latching profile 112 which matingly engages an annular latching seat 114 on mandrel 20. A plurality of belville springs 116 are used to preload mechanical latch 100, which maintains profiles 112 of segments 102 in latched engagement with annular latching seat 114 until a preset force is exerted upon mandrel 20 which offsets the biasing force provided by springs 116. When the biasing force of springs 116 is offset, inclined surfaces 103 and 105 of segments 102 slide along inclined surfaces 108 and 110 of annular rings 104 and 106 permitting latch 100 to move to an unlatched position. Mechanical latch 100 is positioned in a fluid filled latch chamber 120 formed between housing 18 and mandrel 20. Latch chamber 120 has a first end 122 and a second end 124. Fluid chamber 36 having restrictive bore 46 and valve 52, is positioned immediately adjoining first end 122 of latch chamber 120. Pressure balancing pistons 126 and 128, are positioned at first end 122 and second end 124, respectively, of latch chamber 120. Each piston has a first face 130 and a second face 134. Sealing engagement is maintained between pistons 126 and 128 and housing 18 and mandrel 20 be a plurality of peripheral seals 136. A passage 138 is provided whereby drilling fluids exert a force upon second face 134 of piston 128 positioned at second end 124 of latch chamber 120. The force exerted by drilling fluids causes piston 128 to move to a position of equilibrium wherein a like pressure is exerted by first face 132 of piston 128 upon fluids in latch chamber 120. Piston 126 being positioned at first end 122 of latch chamber 120 is placed under like pressure and in turn exerts a like pressure upon fluids within fluid chamber 120. The presence of piston 126 prevents metal chips which inevitably a produced as a result of the operation of latch 100 from migrating from latch chamber 120 to fluid chamber 36, where they could adversely effect the operation of valve 52. A sleeve 140 is positioned at second end 124 of latch chamber 120. Sleeve 140 places a preload on springs 116 which also providing sufficient room of the operation of piston 128.

It will be apparent to one skilled in the art that the valving described as part of the present invention permits two way jarring action with a simplified valving arrangement. It will also be apparent to one skilled in the art that modifications can be made to the preferred embodiment without departing from the spirit and scope of the invention. In particular, it will be apparent to one skilled in the art that a variety of valve configurations, and a variety of mechanical latch configurations can be used in accordance with the teaching of the invention.

The embodiments of the invention in which an exclusive property or privilege is claimed are defined as follows:

1. An improvement in a valve for an hydraulic drilling jar having a tubular housing with an interior surface defining an inner bore, a mandrel telescopically received within the inner bore of the housing, one of the mandrel or the housing having a first projecting anvil and a second projecting anvil in spaced apart relation, the other of the mandrel or the housing having a first projecting hammer and a second projecting hammer in spaced apart relation, one of the mandrel or housing being telescopically moveable in a first direction until the first hammer strikes the first anvil and telescopically moveable in a second direction until the second hammer strikes the second anvil, the improvement comprising:

a. a fluid chamber having a first end and a second end disposed between the housing and the mandrel, the fluid chamber being divided into a first chamber and a second chamber by a restrictive bore;

b. sealing means for sealing the first end and second end of the fluid chamber;

c. an annular valve mounted on the exterior surface of the mandrel between a first shoulder and a second shoulder, the valve having a first end, a second end and an exterior surface, the valve substantially obstructing the flow of fluid within the fluid chamber when the valve is positioned in the restrictive bore thereby hydraulically coupling the mandrel and the housing until a compression or tension force is exerted, the valve having a first bypass passage whereby fluid passes from the first chamber to the second chamber creating a time delay as the valve slowly moves out of the restrictive bore whereupon telescopic movement in the first direction is unrestricted, the valve having a second bypass passage whereby fluid passes from the second chamber to the first chamber creating a time delay as the valve slowly moves out of the restrictive bore whereupon telescopical movement in a second direction is unrestricted, the valve being slidably moveable on the mandrel between the first shoulder and the second shoulder such that the second shoulder obstructs the second bypass passage when the mandrel moves in the first direction and the first shoulder obstructs the first passage when the mandrel moves in the second direction.

2. An hydraulic drilling jar as defined in claim 1, the first bypass passage being comprised of a longitudinal groove in the exterior surface of the valve, and the second bypass passage being comprised of a longitudinal groove in the exterior surface of the valve.

3. An hydraulic drilling jar as defined in claim 1, the first bypass passage being comprised of transverse groove in the second end of the valve, and the second bypass passage being comprised of a transverse groove in the first end of the valve.

4. An hydraulic drilling jar as defined in claim 1, the first bypass passage being comprised of a longitudinal bore through the valve having an adjoining transverse groove in the second end of the valve, and the second bypass passage being comprised of a longitudinal bore through the valve having an adjoining transverse groove in the first end of the valve.

5. An hydraulic drilling jar as defined in claim 1, the first bypass passage being comprised of a longitudinal bore through the valve having an adjoining transverse bore adjacent the second end of the valve, and the second bypass passage being comprised of a longitudinal bore through the valve having an adjoining transverse bore adjacent the first end of the valve.

6. An hydraulic drilling jar as defined in claim 1, the first bypass passage being comprised of an "L" shaped bore through the valve having a first portion extending longitudinally, a second portion adjacent the second end of the valve which extends transversely, and a longitudinal groove extending across the exterior surface of the valve from the second portion to the second end of the valve, and the second bypass passage being comprised of an "L" shaped bore through the valve having a first portion extending longitudinally, a second portion adjacent the first end of the valve which extends transversely, and a longitudinal groove extending across the exterior surface of the valve from the second portion to the first end of the valve.

7. An hydraulic drilling jar as defined in claim 1, having a metering device disposed in the bypass passages to meter the flow of fluid.

8. An hydraulic drilling jar as defined in claim 1, having a mechanical latch disposed between the housing and the mandrel thereby locking the mandrel within the housing until a preset tension or compression force is exerted.

9. An improvement in a valve for an hydraulic drilling jar having a tubular housing with an interior surface defining an inner bore, a mandrel telescopically received within the inner bore of the housing, one of the mandrel or the housing having a first projecting anvil and a second projecting anvil in spaced apart relation, the other of the mandrel or the housing having a first projecting hammer and a second projecting hammer in spaced apart relation, one of the mandrel or housing being telescopically moveable in a first direction until the first hammer strikes the first anvil and telescopically moveable in a second direction until the second hammer strikes the second anvil, the improvement comprising:

a. a fluid chamber having a first end and a second end disposed between the housing and the mandrel, the fluid chamber being divided into a first chamber and a second chamber by a restrictive bore;

b. sealing means for sealing the first end and second end of the fluid chamber;

c. an annular valve mounted on the exterior surface of the mandrel between a first shoulder and a second shoulder, the valve having a first end, a second end and an exterior surface, the valve substantially obstructing the flow of fluid within the fluid chamber when the valve is positioned in the restrictive bore thereby hydraulically coupling the mandrel and the housing until a compression or tension force is exerted, the valve having a first fluid bypass passage whereby fluid passes from the first chamber to the second chamber creating a time delay as the valve slowly moves out of the restrictive bore whereupon telescopic movement in the first direction is unrestricted, the first bypass passage being an "L" shaped bore having a first portion extending longitudinally from the first end of the valve and a second portion adjacent the second end of the valve which extends transversely, a longitudinal groove extends across the exterior surface of the valve from the second portion to the first end of the valve, a second fluid bypass passage whereby fluid passes from the second chamber to the first chamber creating a time delay as the valve slowly moves out of the restrictive bore whereupon telescopic movement in the second direction is unrestricted, the second bypass passage being an "L" shaped bore having a first portion extending longitudinally from the second end of the valve and a second portion adjacent the first end of the valve which extends transversely, a longitudinal groove extends across the exterior surface of the valve from the second portion to the first end of the valve, a metering device being disposed in the first portion each of the first bypass passage and the second bypass passage, a first fluid return passage having a longitudinal bore with a connecting transverse bore adjacent the first end of the valve, a second fluid return passage having a longitudinal bore with a connecting transverse bore adjacent the second end of the valve, whereby an alternate path for use by fluids when repositioning the valve in the restrictive bore, the valve being slidably movable on the mandrel between the first shoulder and the second shoulder, such that when the valve is positioned within the restrictive bore the second shoulder obstructs the second bypass passage and one end of both fluid return passages when the mandrel moves in the first direction, and the first shoulder obstructs the first passage and one end of both fluid return passages when the mandrel moves in the second direction.

10. An hydraulic drilling jar as defined in claim 9, having a mechanical latch disposed between the housing and the mandrel whereby the mandrel is locked within the housing until a preset tension or compression force is exerted.

11. An hydraulic drilling jar as defined in claim 10, having the mechanical latch positioned in a fluid filled latch chamber having a first end and a second end, the fluid chamber having the restrictive bore adjoining the latch chamber, and pressure balancing pistons being positioned at either end of the latch chamber, each piston having a first face and a second face, a passage being provided whereby drilling fluids exert a force upon the second face of the piston positioned at the second end of the latch chamber, thereby causing the piston to move to a position of equilibrium wherein a like pressure is exerted by the first face upon fluids in the latch chamber, the piston at the first end of the latch chamber exerting a like pressure upon fluids within the fluid chamber and preventing metal chips from migrating from the latch chamber t the fluid chamber.

* * * * *

UNITED STATES PATENT AND TRADEMARK OFFICE

CERTIFICATE OF CORRECTION

PATENT NO. : 5,123,493

DATED : June 23, 1992

INVENTOR(S) : Kenneth H. Wenzel

It is certified that error appears in the above-identified patent and that said Letters Patent is hereby corrected as shown below:

On title page, add the following, item

--[30] Foreign Aplication Priority Data
Apr. 27, 1990 [CA] Canada.....2,015,647--.

Signed and Sealed this

Twenty-fourth Day of August, 1993

Bruce Lehman

*Attest:*

BRUCE LEHMAN

*Attesting Officer*

*Commissioner of Patents and Trademarks*